US005769661A

United States Patent [19]

Nealis

[11] Patent Number: 5,769,661

[45] Date of Patent: Jun. 23, 1998

[54] IN-SERVICE REMOVABLE CABLE GROUND CONNECTION

[75] Inventor: Edwin J. Nealis, Cary, N.C.

[73] Assignee: Ericsson, Inc., Research Triangle Park, N.C.

[21] Appl. No.: 788,122

[22] Filed: Jan. 23, 1997

[51] Int. Cl.[6] ..... H01R 13/74

[52] U.S. Cl. ..... 439/551; 439/546; 439/939

[58] Field of Search ..... 439/551, 546, 439/92, 579, 98, 939

[56] References Cited

U.S. PATENT DOCUMENTS

| | | | |
|---|---|---|---|
| 3,750,090 | 7/1973 | Teman | 439/551 |
| 4,273,407 | 6/1981 | Snuffer et al. | 439/579 |
| 4,541,683 | 9/1985 | Van Domelen | 439/551 |
| 4,790,774 | 12/1988 | White | 439/551 |
| 5,044,978 | 9/1991 | Gelin | 439/579 |
| 5,413,502 | 5/1995 | Wang | 439/551 |

*Primary Examiner*—Gary F. Paumen
*Attorney, Agent, or Firm*—Jenkins & Gilchrist, P.C.

[57] ABSTRACT

The body of a connector assembly is attached to the ground of a cable internally disposed within an enclosure. The connector body has a radial flange positioned on the outside surface of the enclosure and a nut, threaded onto a portion of the connector extending internally into the enclosure, is used to secure the connector body whereby a ground connection is established between the connector body and the enclosure. The enclosure panel on which the body is mounted is connected to ground. A mating connector is attachable to a portion of the connector body extending outwardly from the enclosure. In normal service, the slot in which the connector assembly is mounted is covered. However, when necessary to access the interior of the enclosure, the connector and attached cables can be removed from the enclosure panel by removing the cover, loosening the nut disposed on the internal end of the connector body, and sliding the assembled connector and cable pair out of the slot. The connector, and cable pair attached thereto, can be moved out of the way without separation or disconnection. This invention addresses the problem of requiring disconnection of mating cable pairs when performing maintenance, inspection, repair, or other activity on enclosed electronic components such as the base station of a mobile telephone system.

7 Claims, 4 Drawing Sheets

IN-SERVICE REMOVABLE CABLE GROUND CONNECTION

BACKGROUND OF THE INVENTION

Technical Field

This invention relates generally to an electrical connector for transmitting electrical signals from a cable connected to one side of a grounded bulkhead or panel to a mating connector, and more particularly to such a connector that is removable from the bulkhead or panel without disconnecting the cable or mating connector.

History of Related Art

Grounded cables, such as coaxial cables having a braided sheath or separate wire ground conductor, are used in many applications to conduct electrical signals between remotely spaced electronic components. For example, in cellular telephone systems, one or more cable pairs are used to transfer voice and data between a base station and a mobile telephone switching office. Electromagnetic emissions generated inside the base station enclosure are carried outside of the enclosure by the interconnecting cables. One method of reducing electromagnetic emissions radiated from the cables includes incorporating ferrite devices in the cable structure. Such devices are based on the use of ferrites in powdered, compressed, sintered form, making use of their ferrimagnetism and their high electrical resistivity, which makes eddy-current losses extremely low at high frequencies. However, it has been found that ferrites do not assure adequate attenuation of electromagnetic emissions at lower frequencies.

An alternative method of reducing radiated electromagnetic emissions includes grounding the cables, more specifically by grounding the braided sheath surrounding the signal conductor in coaxial cables, or other ground member in the cable such as a separate wire lead. Grounding the cables as they exit the enclosures, by way of a grounded bulkhead connector, has been found to be an effective way of reducing electromagnetic emissions radiated from cables used to connect a base station to external equipment. Traditional bulkhead connectors, pre-attached to the internal cable, must be inserted through a hole in a panel and secured by a nut threaded onto the connector from the outside of the enclosure. This requires that a mating cable be disconnected from the bulkhead connector in order to remove the bulkhead connection and access components obstructed by the cable and connector. This requires that the base station be taken out of service during any maintenance procedure that would require removal of the front panel. Furthermore, the size restriction of a base station and the requirement for easy accessibility to internal components for maintenance make the use of standard bulkhead connectors undesirable.

It is therefore desirable to have a removable cable ground connection that will permit the removal of front, or other access panels, without requiring that the connection between internally and externally disposed electronic components be disconnected and taken out of service. It is also desirable to have such a connector that can be readily removed from the panel without the use of wrenches, special tools, or other devices.

BRIEF SUMMARY OF THE INVENTION

In accordance with one aspect of the present invention, a ground connection for a cable having a ground member includes a grounded first panel which provides a wall surface and a second panel that is positionable in at least partially overlapping relationship with a predefined portion of the first panel. The first panel has at least one edge that is exposed in response to removing the second panel from the overlapping relationship, and also has a slot extending inwardly from the edge to a position spaced from the edge. The ground connection also includes an electrical connection assembly having a body electrically connectable to the ground member of the cable and adapted to be received within the slot provided in the first panel. The body of the connection assembly has an externally threaded first end portion, a second end portion, and a radial flange extending outwardly from the body at a position between the first and second end portions. The electrical connector assembly also includes an internally threaded member attachable to the first end of the body and arranged to secure the body to the first panel in response to tightening the internally threaded member on the externally threaded first end portion of the body. When tightened, the internally threaded member is maintained in biased, tightly abutting electrical contact with a defined internal surface of the first panel and the radial flange of the body is maintained in biased, tightly abutting electrical contact with the defined external surface of the first panel.

Other features of the ground connection for a cable having a ground member, in accordance with the present invention, include the electrical connector assembly also having a mating connector that is adapted to be engageable with the second end portion of the body of the electrical connector. Other features include the internally threaded member and mating connector of the connector assembly each having a knurled outer surface adapted for hand installation on, and removal from, the respective end portions of the body of the connector assembly. Still other features include the first end portion of the body of the connector assembly being adapted for attachment to a coaxial cable having a braided sheath, the first panel being a sidewall of an enclosure for a mobile telephone system base station, and the second panel being a front cover for the base station enclosure.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF THE INVENTION

Figure 1:
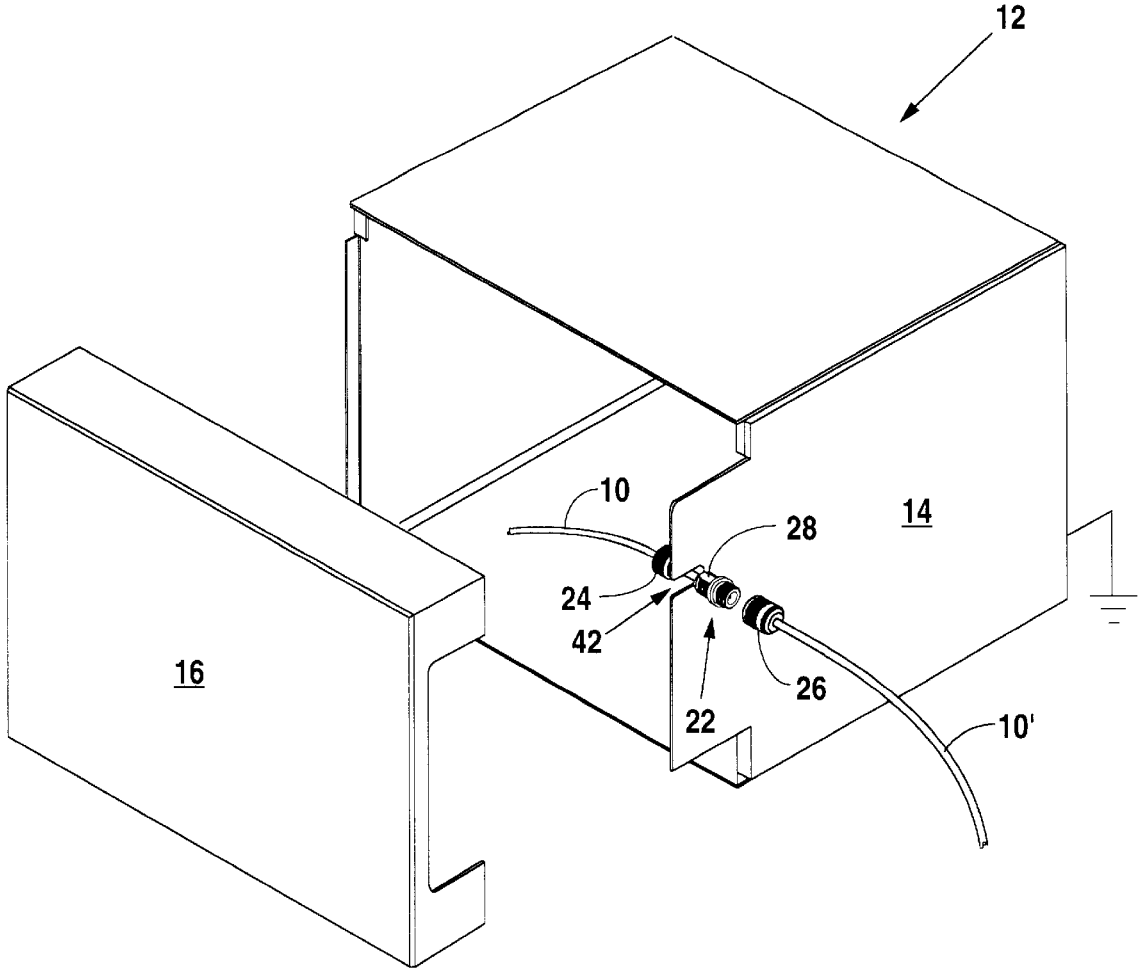
FIG. 1 is a three-dimensional view of an enclosure provided with a ground connection for a cable connector, in accordance with the present invention.

In the preferred embodiment of the present invention, a ground connection for a cable 10 having a ground member is illustrated in the drawings in association with an enclosure 12 adapted to house various electronic components, such as those forming the base station of a mobile telephone system. Such base stations typically have three or four cable pairs that extend between the base station and a mobile telephony switching office and an antenna. Each cable pair includes a cable 10 internal to the base station enclosure, and a cable 10' external to the enclosure. All of such cables, 10, 10' are typically coaxial in construction, i.e., they have a single centrally disposed signal conducting wire surrounded by insulation over which a braided sheath surrounds the central wire and insulation. Two cable pairs, typically BNC connectors, are pulse code modulation (PCM) cables that transfer voice and data between the base station and the mobile telephony switching office. Generally, one or two additional cable pairs use N-connectors. If one additional cable pair is used, it is generally a transmit/receive cable pair that connects to an antenna. If two additional cable pairs are used, one is the transmit/receive cable pair and the other one is the receive cable pair, each of which connect to an antenna. The antenna transmits and receives voice and data to and from cellular subscribers. The transmit/receive cable pair carry voice and data both into and out of the base station. The receive cable pair only carries voice and data into the base station. Although only one cable pair 10, 10' is shown in the attached drawings, the arrangement and construction of the below-described described removable cable ground connection is applicable to all such cable pairs between the base station and the remote mobile telephony switching office.

In the illustrated arrangement of the preferred embodiment of the present invention, the enclosure 12 includes a plurality of rectangular panels, including a side panel 14 and a removable front cover 16. The enclosure 12 is grounded by electrical connection with a ground 18 that may be provided by the ground lead of a three-prong power plug, or, alternatively, to an external ground source. In the internal cables, the braided shield of the coaxial cable 10 is connected by conventional means, such as by crimping, solder attachment, or pressure clamping, to a body 20 of an electrical connector assembly 22. In the present invention, the body 20 of the electrical connector assembly 22 may comprise a type N, BNC, or other type of bulkhead connector. The electrical connector assembly 22 further includes a knurled nut 24 and a mating connector 26. Desirably, the outer surface of the mating connector 26 is also knurled to enable installation or removal by hand operation without the need for wrenches or other tools.

Figure 2:
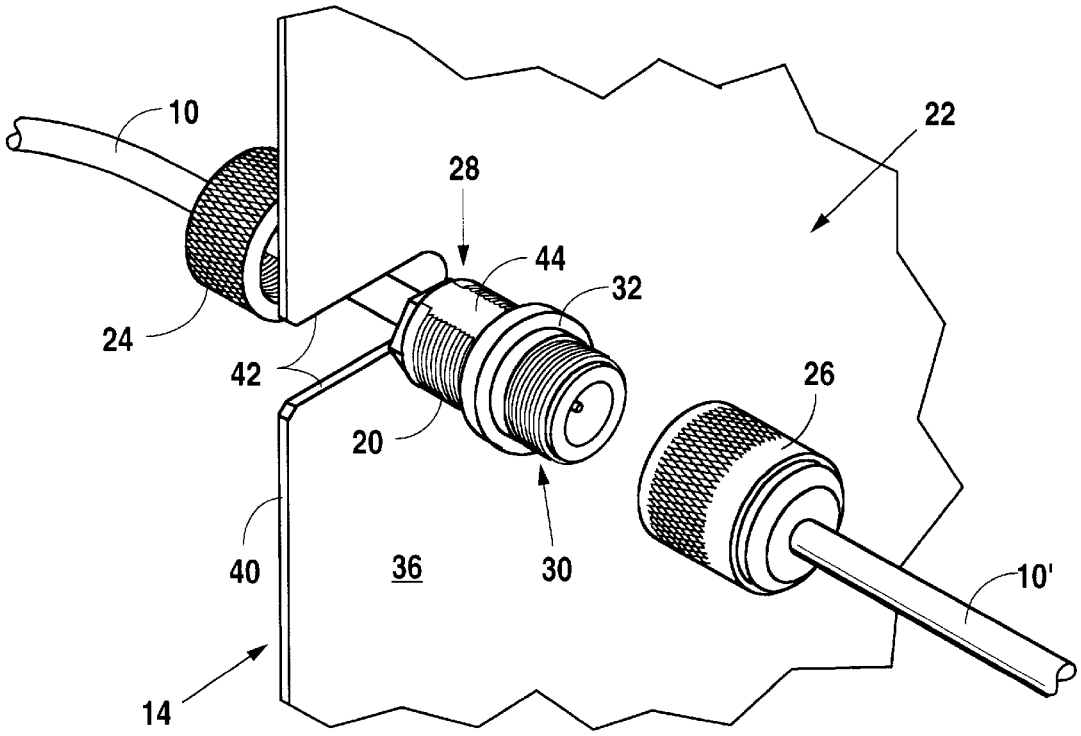
FIG. 2 is an exploded three-dimensional view showing the components of the ground connection embodying the present invention, in spaced relationship with each other.
Figure 7:
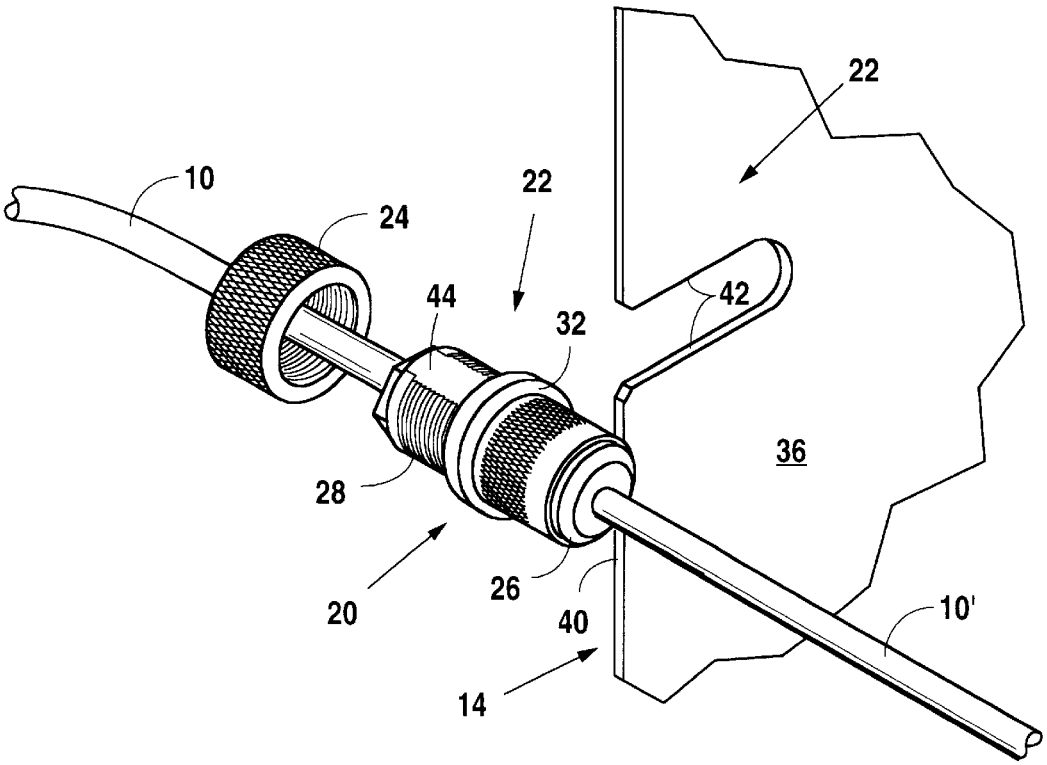
FIG. 7 is a three-dimensional view of the electrical connector assembly of the ground connection for a cable having a ground member, in accordance with the present invention, showing the electrical connector assembly removed from a mounting panel.

As best shown in FIGS. 2 and 7, the body 20 of the electrical connector assembly 22 has an externally threaded first end portion 28, and a second end portion 30 which may be externally threaded, as shown in the drawing, or provided with other engageable surface features such as slots, recesses, pins, and the like, depending upon the arrangement of the mating connector 26. The body 20 of the electrical connector assembly 22 also includes a radial flange 32 extending outwardly from the body 20 at a position approximately midway between the first and second end portions 28, 30.

The grounded side panel 14 of the enclosure 12 has an external planar surface 36 and a vertically disposed edge 40 extending between the external surface 36 and an internal planar surface that is not visible in the drawings. The vertical edge 40 may be provided by a flange extending toward the front of the enclosure 12, as shown in the drawings, or incorporated in an edge of the panel 14 that is substantially aligned with the edges of the top, bottom, and other side of the enclosure 12. In the arrangement shown, the forwardly extending flange is received within a clearance opening provided in the front cover 16. When the front cover 16 is installed on the enclosure 12, the vertical edge 40 and a portion of the external surface 36 of the side panel 14 are covered by the front cover 16. As can be readily seen, the vertical edge 40 is exposed in response to moving the cover 16.

Importantly, the grounded side panel 14 of the enclosure 12 includes a slot 42 having a predetermined width. The slot 42 extends inwardly from the vertical edge 40 to a position that is spaced from the edge 40. The portion of the slot 42, not occupied by the body 20 of the electrical connector assembly 22 when installed, is covered when the front panel 16 is assembled onto the enclosure 12. If desired, a small circular relief having a diameter substantially equal to that of the radial flange 32 of the body 20 may be provided in the inner vertical edge of the cover 16 at a position aligned with the body 20 when the cover 16 is assembled with the enclosure 12.

To assemble the removable ground connection embodying the present invention, the front cover 16 of the enclosure 12 is removed and the electrical connection assembly 22, comprising the knurled nut 24, the body 20 to which the internal cable 10 is attached and the mating connector 26 to which the external cable 10' is attached, are installed in the slot 42 with the components of the assembly 22 arranged as shown in FIG. 2. Desirably, the first end portion 28 of the body 20 has a pair of parallel flat surfaces 44, only one of which is visible in the drawings, that are formed on opposite sides of an otherwise generally cylindrical threaded shape. By this construction, the predetermined width of the slot 42 formed in the side panel 14 is less than the diameter of the generally cylindrical outer shape of the body 20 and substantially equal to, or only slightly greater than the distance between the parallel flat surfaces 44 on the body 20. Thus, the body 20 is prevented from rotation with respect to the side panel 14 by the slot 42, and the knurled nut 24 and mating connector 26 can be easily attached or removed by hand, from the respective end portions 28, 30 of the body 20.

Figure 3:
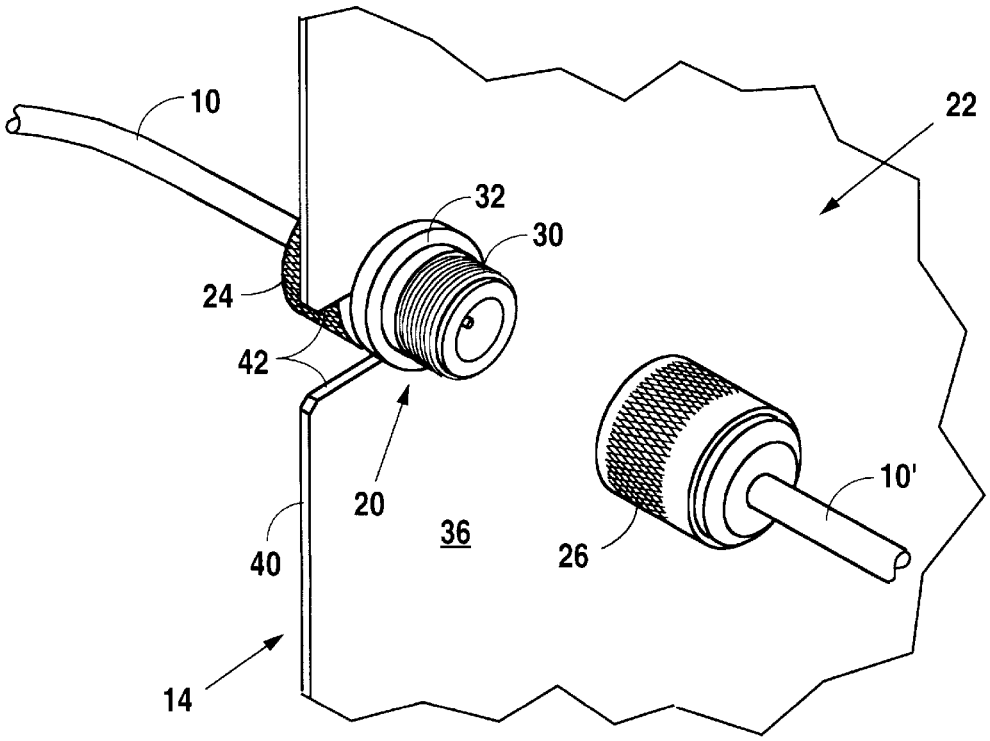
FIG. 3 is a three-dimensional view of the electrical connector assembly of the ground connection for a cable having a ground member, in accordance with the present invention, showing the connector assembly body mounted onto a panel of the enclosure, and the mating cable disconnected from the body.

After arrangement of the respective components as illustrated in FIG. 2, the knurled nut 24, having internal threads adapted to mate with the threaded first end portion 28 of the body 20 is loosely threaded onto the body 20 in spaced relationship from the radial flange 32. While maintaining this respective position of the components, the assembly is inserted in the slot with the flat surfaces 44 of the body aligned with the sides of the slot 42, and moved, by sliding, to a position at which the body 20 abuts the end of the slot 42. The knurled nut 24 is thus positioned adjacent the defined internal surface of the side panel 14 and the radial flange 32 is positioned adjacent the defined external surface 36 of the side panel 14. The knurled nut 24 is then manually tightened, by hand, onto the first end portion 28 of the body 20 until it tightly abuts the internal surface of the side panel 14. Thus, when tightened, the knurled nut 24 is maintained in biased, tightly abutting electrical contact with the internal surface of the side panel 14, and the radial flange 32 of the body 20 is maintained in biased, tightly abutting electrical contact with the external surface 36 of the side panel 14. The installed position of the body 20 and knurled nut 24 of the electrical connector assembly 22 on the side panel 14 is illustrated in FIG. 3.

Figure 4:
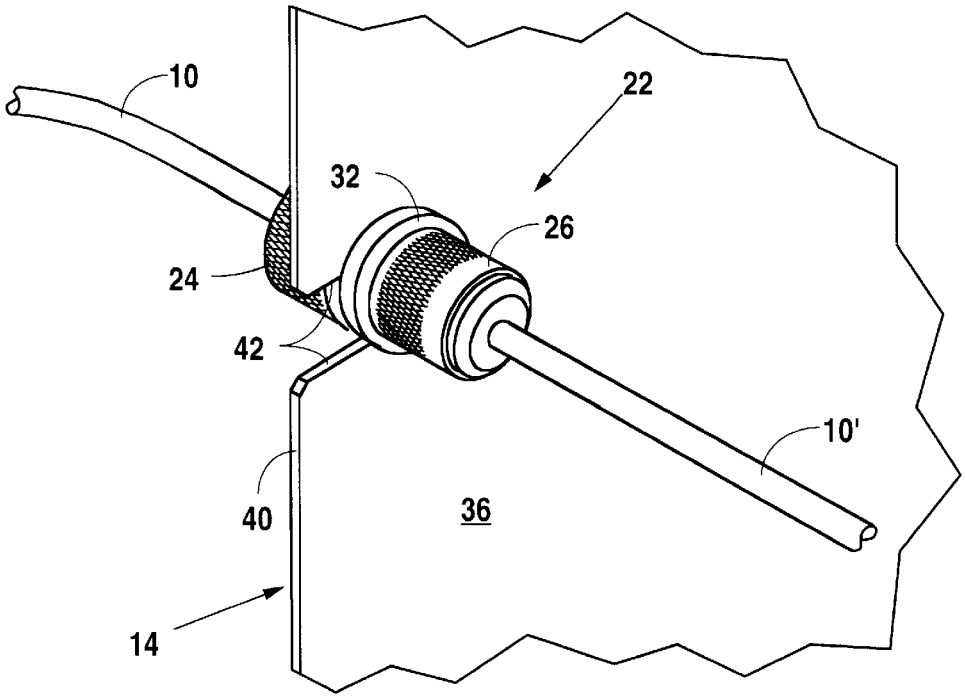
FIG. 4 is an enlarged three-dimensional view of the ground connection for a cable having a ground member, in accordance with the present invention, showing the connector assembly assembled onto a panel of the enclosure.
Figure 5:
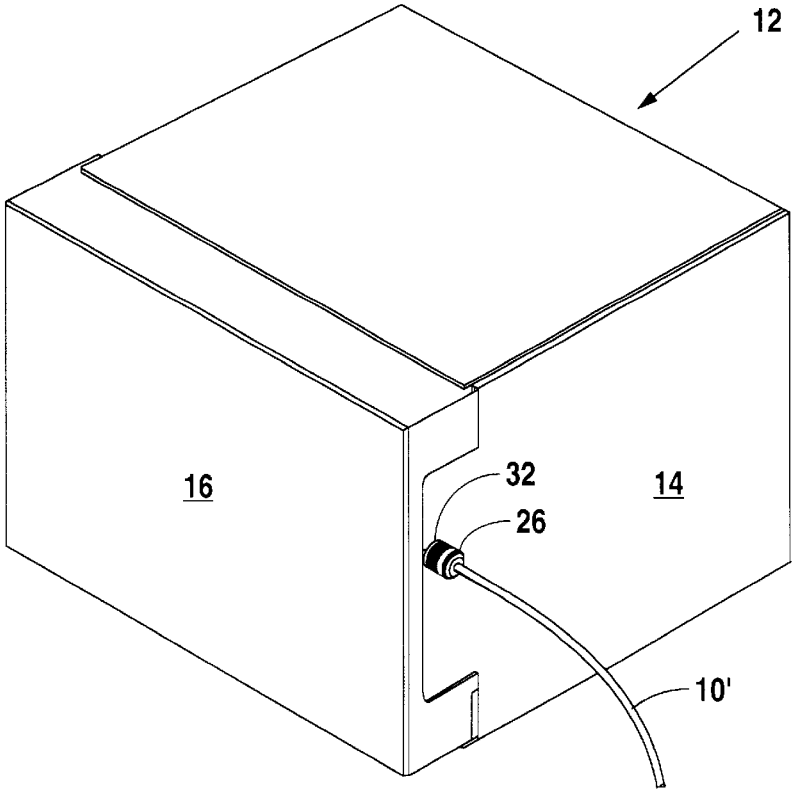
FIG. 5 is a three-dimensional view of the enclosure on which a ground connection for a cable having a ground member, in accordance with the present invention, is shown with the enclosure cover installed and a mating cable attached.

Importantly, the mating connector 26 may be attached to the body 20, as illustrated in FIG. 4, either before or after mounting of the body 20 to the side panel 14. To complete assembly of the enclosure 12, the front cover 16 is attached over the open end of the enclosure 12 and over the side panel 14 as shown in FIG. 5.

Figure 6:
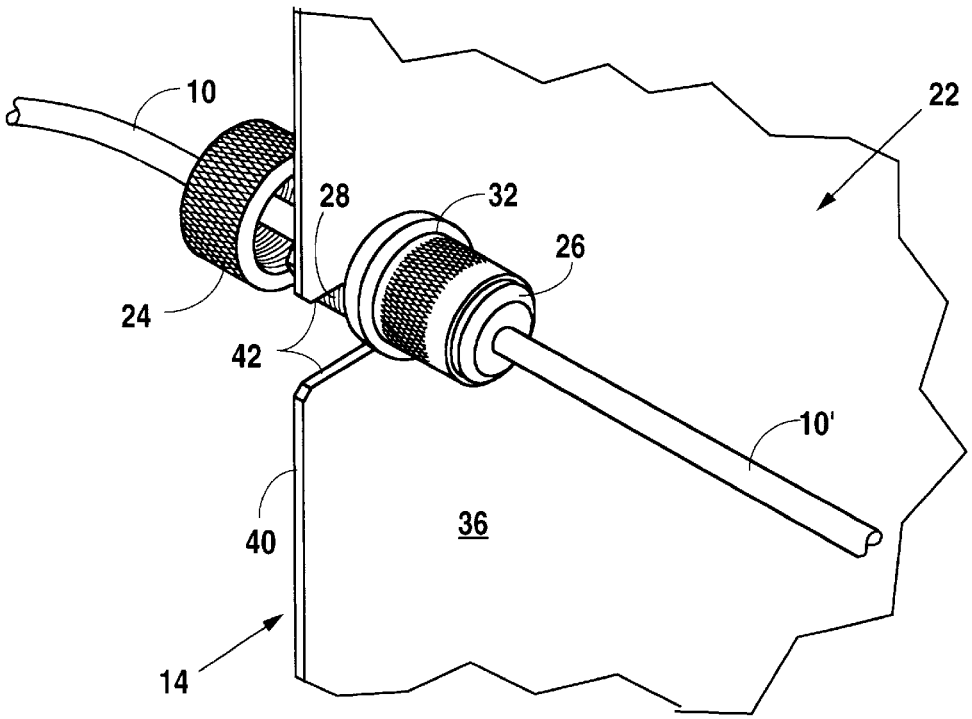
FIG. 6 is an enlarged three-dimensional view of the ground connection embodying the present invention, with an internal nut detached from the body of an electrical connector assembly.

After installation of the removable ground connection embodying the present invention, the connected cable pair 10, 10' may, if desired, be removed from the side panel without disconnection. If, for whatever reason, i.e., inspection, repair or routine maintenance, it is necessary to access a component housed within the enclosure 12, the front cover 16 may be removed and the knurled nut 24 manually loosened as illustrated in FIG. 6. The connected cable pair, 10, 10', may then be easily removed from the side panel 14 by sliding the body 20 along the slot 42 to a position spaced from the side panel 14 without disturbing the electrical connection between the internal cable 10 and the external cable 10'. Once clear of the side panel 14, the cable pair 10, 10', can be relocated at a position where it does not obstruct or otherwise impede or hinder access to components housed within the enclosure 12.

Thus it can be seen that the connector assembly embodying the present invention provides a removable cable ground connection that is effective in greatly reducing the emissions from cables exiting a base station, yet can be easily moved to allow access to components in the base station without disconnection of the cable pairs. While the use of ferrites placed over cables is one method of reducing emissions without requiring that the cables be attached to the frame of the enclosure and thus would not have to be disconnected to be moved out of the way, such ferrite treated cables often do not adequately reduce electromagnetic emissions. Conventional grounded bulkhead connections and shielded cables adequately reduce emissions, but the mating cables must be disconnected in order to provide access to components in the enclosure. The in-service removable cable ground connection embodying the present invention establishes ground between the enclosure 12 and the cable pair 10, 10' through the use of the body 20 which is electrically connected to the ground of the internal cable 10'. The body 20 is attached to the grounded enclosure 12 by a manually removable nut 24 on the side of the enclosure 12 opposite that to which the mating external cable 10' is connected. Thus, the mounting nut 24 can be loosened and tightened without disturbing the external cable connection.

Once the knurled nut 24 is loosened, the ground connection to the enclosure 12 is lost, but since connection with the mating connector 26 is undisturbed, the connection between the internal cable 10 and external cable 10' remains. This feature not only enables movement of the cable pair, 10, 10' to provide unobstructed access to components housed within the enclosure 12, but also permits the electrical components of the station to remain in service. If desired, a temporary ground can be provided by jumper clips attached between the body 20 and the enclosure 12.

By grounding the internal cable 10 at its point of exit from the enclosure 12, i.e, the point at which the external cable 10' is mated to the internal cable 10, the majority of electromagnetic emissions conducted by the internal cable 10 inside the enclosure 12 are not carried outside of the enclosure 12. Also, since the body 20 is mounted in an open-ended slot 42 and not inserted through a hole, the body 20 can be shifted laterally out of the slot 42 in the enclosure 12 once the nut 24 is loosened, without disturbing the connection with the mating external connector 26.

Although the present invention is described in terms of a preferred exemplary embodiment, with specific illustrative key constructions and connector arrangements, those skilled in the art will recognize that changes in those constructions and arrangements may be made without departing from the spirit of the invention. For example, the internal and external cable pair 10, 10' may contain one or more signal conductors and may also have a ground wire which is electrically connected to the panel-mounted body 20. Also, if desired, the mounting slot 42 may be formed in the front cover 16, with an orthogonal portion of the side panel 14 providing a partial covering over the slot 42. Such changes are intended to fall within the scope of the following claims. Other aspects, features, and advantages of the present invention may be obtained from a study of this disclosure and the drawings, along with the appended claims.

What is claimed is:

1. A ground connection for a cable having a ground member, comprising:

a grounded first panel forming a wall surface and a second panel positionable in at least partially overlapping relationship with a predefined portion of the first panel, said first panel having defined internal and external planar surfaces, at least one edge extending between said planar surfaces that is exposed in response to removing said second panel and a slot having a predetermined width extending inwardly from said edge to a position spaced from said edge; and an electrical connector assembly including a body electrically connectable to said ground member of the cable and adapted to be received within said slot at a position spaced from said edge of the first panel, said body having an externally threaded first end portion, a second end portion, and a radial flange extending outwardly from said body at a position between said first and second end portions, an internally threaded member attachable to the first end portion of the body and arranged to secure said body to said first panel in response to tightening the internally threaded member on said externally threaded first end portion of the body whereby said internally threaded member is maintained in biased tightly abutting electrical contact with said defined internal surface of the first panel and said radial flange of the body is maintained in biased tightly abutting electrical contact with said defined external surface of the first panel.

2. A cable ground connection, as set forth in claim 1, wherein the first end portion of the body of said connector assembly has a generally cylindrical outer shape except for a pair of parallel flat surfaces formed on diametrically opposed sides of the cylindrical shape and the predetermined width of said slot is less than the diameter of said generally cylindrical outer shape of the body, said body being mountable on said first panel in response to aligning the opposed flat surfaces of the body with said slot, positioning said radial flange adjacent said defined external surface of the first panel, sliding the body to said position spaced from the edge of said first panel, and tightening said internally threaded member onto the first end portion of body.

3. A cable ground connection, as set forth in claim 1, wherein said internally threaded member attachable to the first end portion of the body of the connector assembly is a knurled nut adapted for hand installation on and removal from said first end portion of the body without the aid of tools.

4. A cable ground connection, as set forth in claim 1, wherein said electrical connector assembly includes a mating connector adapted for engagement with the second end portion of the body.

5. A cable ground connection, as set forth in claim 4, wherein said mating connector adapted for engagement with the second end portion of the body of the connector assembly has an knurled outer surface aiding hand installation on and removal from said second end portion of the body.

6. A cable ground connection, as set forth in claim 1, wherein the first end portion of the body of said connector assembly is adapted for attachment to a coaxial cable having a braided shield whereby the braided shield is in direct electrical communication with said body of the connector assembly.

7. A cable ground connection, as set forth in claim 1, wherein said first panel is a side wall of an enclosure for a mobile telephone system base station, and said second panel is a front cover for said enclosure.

* * * * *